US006922909B2

(12) United States Patent
Andrew et al.

(10) Patent No.: US 6,922,909 B2
(45) Date of Patent: Aug. 2, 2005

(54) ATTACHMENT FOR HAIR DRYERS

(75) Inventors: Michael A. Andrew, Milford, CT (US); Gregg A. Micinilio, Trumbull, CT (US); Richard Neil Tobin, Monroe, CT (US); John Wilcox, Newport, RI (US)

(73) Assignee: Rovcal, Inc., Madison, WI (US)

( * ) Notice: Subject to any disclaimer, the term of this patent is extended or adjusted under 35 U.S.C. 154(b) by 0 days.

(21) Appl. No.: 10/740,788

(22) Filed: Dec. 19, 2003

(65) Prior Publication Data

US 2004/0163274 A1 Aug. 26, 2004

Related U.S. Application Data

(60) Provisional application No. 60/438,542, filed on Jan. 6, 2003.

(51) Int. Cl.[7] ..... A45D 20/26

(52) U.S. Cl. ..... 34/96; 34/97; 132/271; 392/380; 392/385

(58) Field of Search ..... 34/96, 97; 132/271; 392/380, 381, 382, 383, 384, 385

(56) References Cited

U.S. PATENT DOCUMENTS 3,943,329 A * 3/1976 Hlavac ..... 392/379
4,848,007 A * 7/1989 Montagnino ..... 34/97
5,060,398 A 10/1991 Wolens
5,572,800 A 11/1996 West
5,649,370 A 7/1997 Russo
5,841,943 A * 11/1998 Nosenchuck ..... 392/385
5,956,863 A 9/1999 Allen
5,966,833 A 10/1999 Andis et al.

* cited by examiner

*Primary Examiner*—Denise L. Esquivel
*Assistant Examiner*—Kathryn S. O'Malley
(74) *Attorney, Agent, or Firm*—Melvin I. Stoltz

(57) ABSTRACT

By providing a plurality of portals in a housing which forms a hair dryer attachment which is merely fixed to the exist portal of any conventional hair dryer, a hair dryer attachment is realized which is capable of substantially reducing the drying time required for drying the hair of any individual, while also being easily employed and comfortable. In the preferred embodiment, at least one raised, sloping panel is formed adjacent the inlet portal of the attachment with the panel sloping outwardly from the generally circular shaped inlet portal. In addition, a plurality of apertures or portals are formed in the panel for enabling ambient air to freely flow therethrough. In this way, the heated air flowing through the central portion of the attachment creates a low-pressure zone on the inside surface of the portals, drawing ambient air through the portals into the interior of the hair dryer attachment, thereby enabling the quantity of the air reaching the hair of the user is substantially increased.

17 Claims, 3 Drawing Sheets

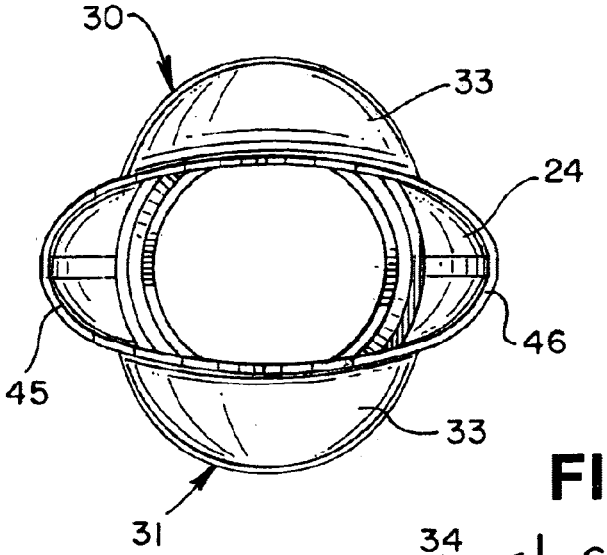
FIG. 4
FIG. 5
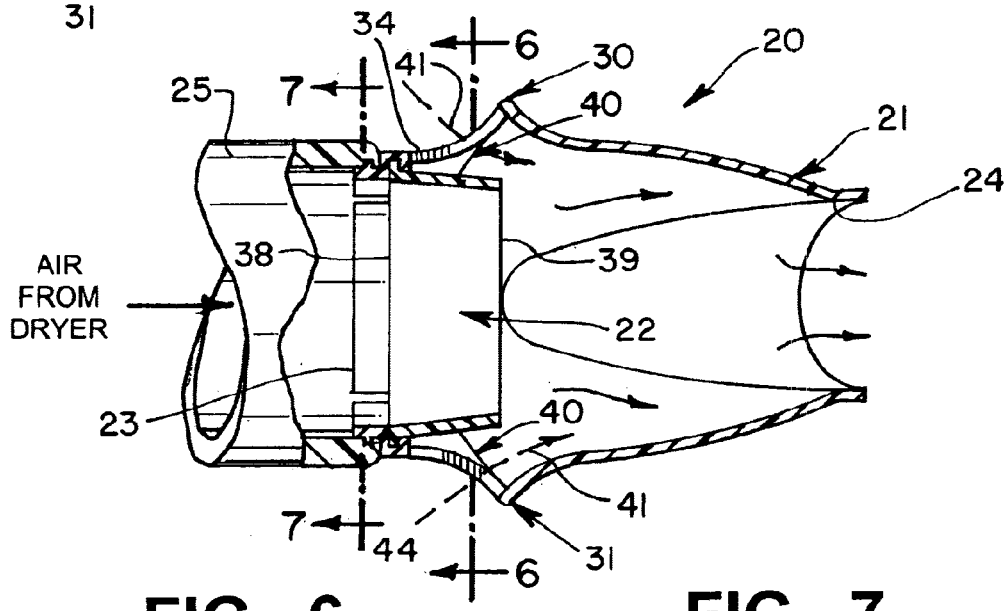
FIG. 6
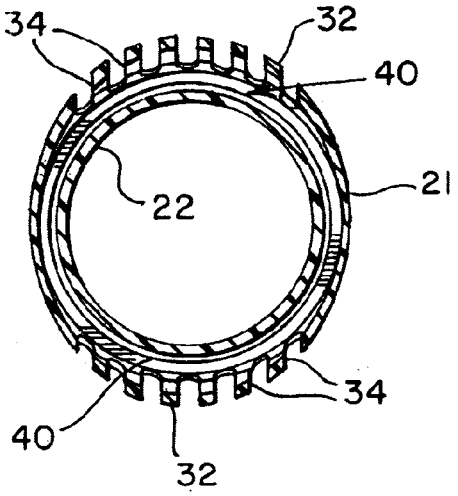
FIG. 7
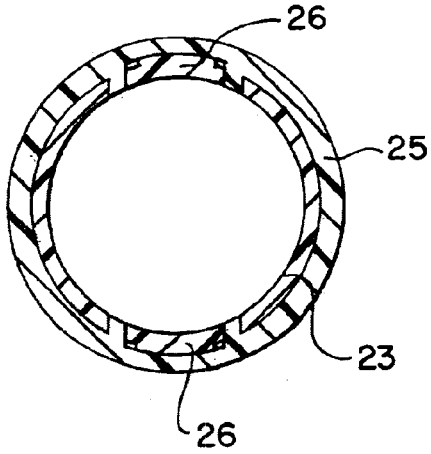

ATTACHMENT FOR HAIR DRYERS

RELATED APPLICATIONS

This application is related to U.S. Provisional Application Ser. No. 60/438,542, filed Jan. 6, 2003, entitled ATTACHMENT FOR HAIR DRYERS.

TECHNICAL FIELD

This invention relates to hair dryers and, more particularly, to an attachment for a hair dryer which substantially enhances and improves the drying of the hair fibers.

BACKGROUND ART

Men and women have had, for many decades, the desire of drying their hair after washing. Typically, a hand-held hair dryer is employed, which is constructed for drawing ambient air through an elongated passageway in which a heat source is retained. As the air flows over the heat source, the temperature of the following air is raised, with the heated air being channeled to an exit portal where the heated air is applied to the user's wet hair fibers. By continuously exposing the wet hair fibers to the heated air stream, the desired drying effect is realized.

In order to meet the substantial demand that has been developed for hand-held hair dryers, a wide variety of styles, configurations, and product enhancements have evolved. However, in spite of the substantial effort that has been expended in developing a universally acceptable hair dryer, the industry has failed to achieve a hand-held hair dryer which is capable of satisfying all of the consumer demands imposed thereon. In this regard, one principal objection raised by many users is the inability of achieving optimum drying of one's hair in a minimum period of time.

In attempting to satisfy this desire of most consumers, the heating elements contained in the hand-held hair dryers have been increased in order to impart higher and higher temperatures to the air flow. However, although increased temperatures have been realized, consumers have been reluctant to employ hair dryers having substantially increased air flow temperatures, due to the discomfort produced by these products.

In addition, various attachments have been produced for being affixed to the exit portal of a hair dryer in an attempt to channel the air flow in a particular manner which will enhance and/or reduce the necessary drying time. Although some of these attachments have met with some success in satisfying consumer needs, these products have been incapable of achieving universal acceptance by all consumers.

In general, these prior art attachments tend to be large and/or extremely bulky in size, causing the user to experience added weight during the hair drying process, as well as causing the hair dryer itself to have an altered center of gravity. As a result, the user experiences substantial difficulty and inconvenience in holding and supporting the hair dryer, due to the added weight and bulk of the attachment affixed to the discharge end of the hair dryer. Due to these difficulties and inconveniences, these prior art products have not been widely accepted.

Therefore, it is a principal object of the present invention to provide a hair dryer attachment which enables the user to achieve complete drying of the hair in a substantially reduced period of time.

Another object of the present invention is to provide a hair dryer attachment having the characteristic features described above which is quickly and easily affixed to the hair dryer, and comprises a small, compact, light weight construction.

Another object to the present invention is to provide a hair dryer attachment having the characteristic features described above which is capable of substantially increasing the flow of air exiting the attachment, enabling the hair to be dried more rapidly.

Another object of the present invention is to provide a hair dryer attachment having the characteristic features described above which is capable of reducing the hair drying time, without requiring the air to be heated to high temperatures.

Another object to the present invention is to provide a hair dryer attachment having the characteristic features described above which also enables the user to completely control the increased airflow in a simple and easily employed manner.

Other a more specific objects will in part be obvious and will in part appear hereinafter.

SUMMARY OF THE INVENTION

By employing the present invention, all of the difficulties and drawbacks found in prior art hair dryers and hair dryer attachments have been overcome and a hair dryer attachment is realized which is capable of substantially reducing the drying time required for drying the hair of any individual, while also being easily employed and comfortable. In accordance with the present invention, two unique construction elements are provided in a single hair dryer attachment which is merely affixed to the exit portal of any conventional hair dryer to achieve the substantially improved and enhanced results.

In the present invention, a hair dryer attachment is attained which incorporates a substantially circular entry zone or portal constructed for being quickly and easily affixed to any conventional circular shaped hair dryer exit portal. In addition, the opposed or exit end of the hair dryer attachment of the present invention is formed incorporating an enlarged, diverging wall configuration, constructed for channeling and directing the air flowing through the hair dryer attachment to expand or fan outwardly as the air flow exits the attachment. In this way, the air flow stream exiting in the attachment is maximized.

In addition, cooperating with the enlarged, expanding, exit portal of the attachment of the present invention, the present invention also incorporates a plurality of inlet portals formed on the outer surface of the attachment, directly adjacent to the circular shaped entry zone. In the preferred embodiment, at least one raised, sloping panel is formed adjacent the inlet portal of the attachment with the panel sloping outwardly from the generally circular shaped inlet portal. In addition, a plurality of apertures or portals are formed in the panel for enabling ambient air to freely flow therethrough.

By incorporating a plurality of air inlet panels formed on the outer surface of the hair dryer attachment, the heated air flowing through the central portion of the attachment creates a low-pressure zone on the inside surface of the portals, drawing ambient air through the portals into the interior of the hair dryer attachment. As a result, the quantity of the air reaching the hair of the user is substantially increased.

Although the ambient air drawn into the hair dryer attachment slightly reduces the temperature of the flowing air, it has been found that the substantially increased quantity of air flowing through the attachment to the user's hair causes a substantial increase in the hair drying efficacy of the hair dryer, substantially reducing the drying time required to dry the individual's head of hair. By combining this unique portal and increased air flow construction with the enhanced enlarged diverging wall configuration, the hair dryer attachment of the present invention is capable of substantially reducing the drying time normally required by an individual in a totally passive product, having no moving parts and causing no detrimental or adverse effects to the user.

In the preferred construction, two radially extending, sloping panels are formed on the outer surface of the hair dryer attachment with each panel being diametrically opposed from the other. In addition, each panel incorporates a plurality of apertures or slots formed therein for providing the desired air flow passageways. In addition, the hair dryer attachment also preferably incorporates an open ended, hollow, cylindrical tube member having a leading edge adjacent the inlet portal of the hair dryer attachment and a terminating edge which is generally aligned with the terminating edges of the apertures formed in the sloping panels.

By employing this construction, the heated air flow from the hair dryer flows through the substantially cylindrically shaped tube member in a manner which controls the flow to optimize the creation of a reduced pressure zone directly adjacent the terminating edge of the tube member. In this way, a low-pressure zone is created which causes the ambient air to flow into the portals formed in the sloping panels, and merge with the heated air flow stream, delivering a substantially increased volume of air to the user. In this way, the substantially increased and enhanced benefits of the present invention are realized.

In an alternate embodiment, the hair dryer attachment of the present invention incorporates a flow adjusting collar cooperatively associated with the inlet portals formed in the hair dryer attachment for enabling the user to vary the number of portals effectively exposed to the ambient air. In this way, the quantity of air which is capable of entering the hair dryer attachment of the present invention can be increased or decreased in accordance with the user's desires.

In the preferred construction, the flow adjusting collar incorporates a generally circular shaped, rotatable ring member in which at least one, elongated, enlarged portal is formed. In addition, the ring member is constructed for being coaxially aligned with and peripherally surrounding the portion of the hair dryer attachment incorporating the portals. In this way, by arcuately rotating the ring member about its central axis, the enlarged portal formed therein is capable of effectively opening and/or closing one or more of the portals formed in the hair dryer attachment. As a result, the maximum air flow rate through the portals is easily controlled by the user.

By employing the present invention, it has been found that the hair dryer attachment of the present invention provides substantially enhanced performance and improved hair drying speeds, regardless of which embodiment of the present invention is employed. In those instances when complete control over the airflow is required, the alternate embodiment of the present invention with the rotatable control collar is employed.

The invention accordingly comprises a product possessing the features, properties, and the relation of components which will be exemplified in the product hereinafter described, and the scope of the invention will be indicated in the claims.

THE DRAWINGS

For a fuller understanding of the nature and objects of the invention, reference should be had to the following detailed description taken in connection with the accompanying drawings, in which:

FIG. 4 is a front elevation view of the hair dryer attachment of the present invention;

FIG. 5 is a side elevation view, partially in cross-section, depicting the hair dryer attachment in operation, affixed to a hair dryer, the major portion of which has been broken away;

FIG. 6 is a cross-sectional view taken along line 6—6 of FIG. 5;

FIG. 7 is a cross-sectional end view taken along line 7—7 of FIG. 5;

DETAILED DESCRIPTION

Figure 1:
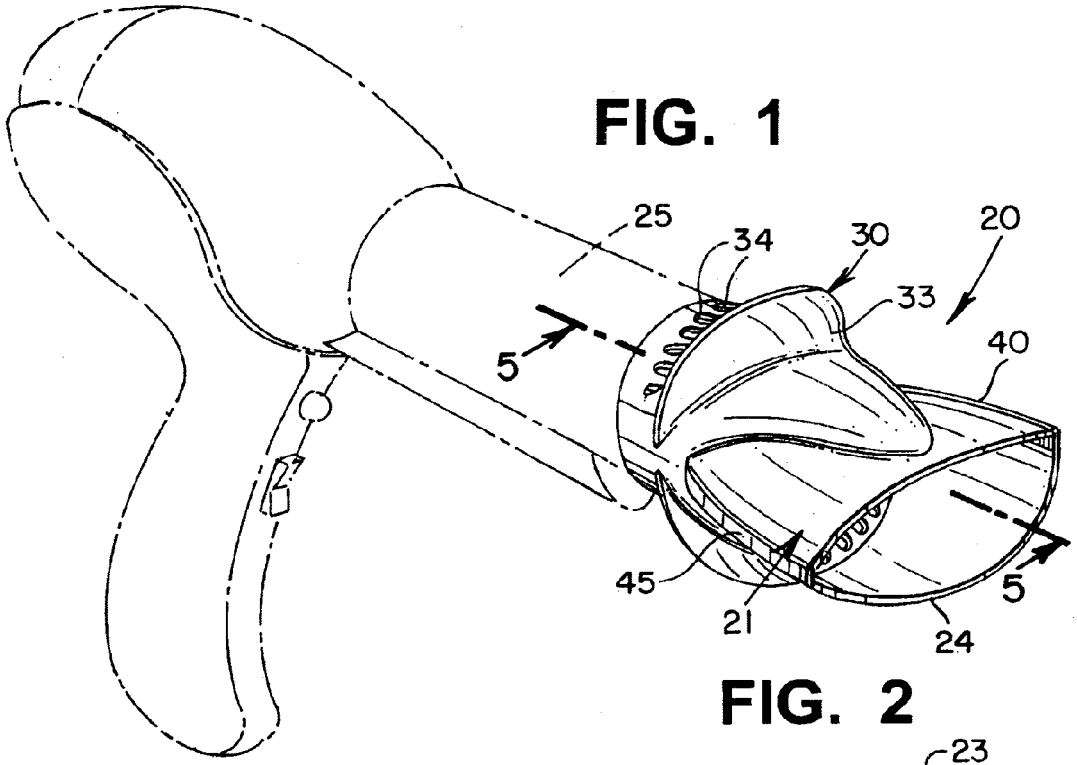
FIG. 1 is a perspective view depicting a conventional hair dryer with the hair dryer attachment of the present invention mounted thereto.
Figure 2:
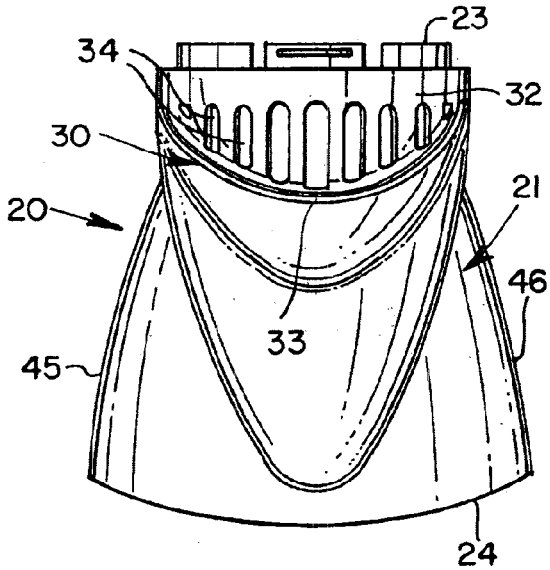
FIG. 2 is a top plan view of the hair dryer attachment of the present invention.
Figure 3:
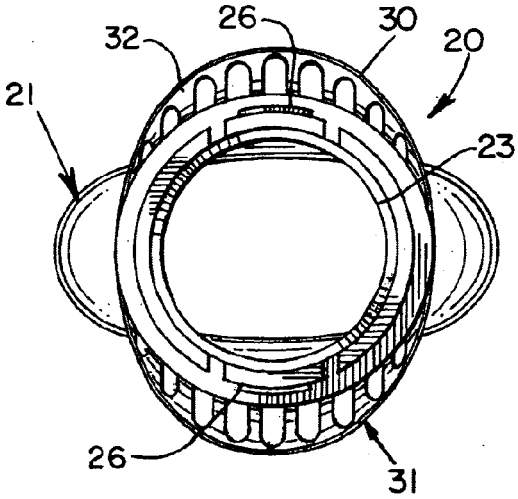
FIG. 3 is a rear elevation view of the hair dryer attachment of the present invention depicting the inlet portal thereof.

By referring to FIGS. 1–10, along with the following detailed discussion, the construction and operation of the two preferred, alternate embodiments of the hair dryer attachment of the present invention can best be understood. Although the preferred embodiments of the present invention are fully disclosed herein, further alternate constructions may be implemented without departing from the scope of this invention. Consequently, it is to be understood that this detailed disclosure is provided for exemplary purposes only and is not intended as a limitation of the present invention.

As fully depicted in FIGS. 1–10, hair dryer attachment 20 of the present invention comprises a uniquely constructed housing 21 in combination with inner tube member 22. In addition, outer housing 21 incorporates a circular shaped inlet portal 23 and an outlet portal 24.

In the preferred embodiments, inlet portal 23 is constructed for being quickly and easily securely mounted to the exit portal of a conventional hair dryer 25, as depicted in FIGS. 1 and 5. Although any desired mounting/engagement system can be employed, it has been found that the incorporation of radially extending tabs or ridges 26 formed on the outer surface of portal 23 enables hair dryer attachment 20 to be quickly and easily inserted into the exit portal of hair dryer 25 and locked in place.

In accordance with the present invention, housing 21 of hair dryer attachment 20 incorporates outwardly extending raised cavities 30 and 31 which are preferably formed diametrically opposed from each other. Each of the outwardly extending, raised cavities 30 and 31 comprise an upwardly, sloping surface or panel 32 extending upwardly from the inlet portal side of housing 21, and downwardly extending panel or surface 33 extending from the terminating edge of panel/surface 32 towards outlet portal 24. In addition, a plurality of apertures 34 are formed in each panel/surface 32. In the preferred construction, apertures 34 comprise elongated slots extending substantially the entire width of panels 32.

As best seen in FIG. 5, tube member 22 comprises a generally cylindrical truncated conical shape extending from leading edge 38 having a first diameter, to trailing edge 39 having a second diameter which is less than the first diameter. In the preferred embodiment, tube member 22 extends substantially the entire width of upwardly sloping panels 32, with trailing edge 39 lying in a plane which is substantially equivalent with the juncture between sloping panels 32 and 33. By employing this construction, interior zone or pocket 40 is established between the outer surface of tube member 22 and the inside surface of panels 32. In addition, as depicted in FIG. 6, pocket or zone 40 also extends the entire arcuate length of panels 32.

By employing this construction, the heated air exiting hair dryer 25 enters inlet portal 23 of hair dryer attachment 20 and is channeled through tube member 22, narrowing as the inside wall thereof narrows. Since tube member 22 effectively defines a continuous, narrowing pathway for the heated air flow, all of the heated air flow from hair dryer 25 flows into inlet portal 23 and through tube member 22. In addition, as the heated air stream from hair dryer 25 flows rapidly passed trailing edge 39 of inner tube member 22, a pressure drop or low-pressure effect is created directly adjacent pocket/zone 40. This low-pressure effect is created in accordance with the well-known Bernoulli's Principle.

By creating an area of low-pressure directly adjacent trailing edge 39 and pocket/zone 40, ambient air is automatically drawn through slots 34 of sloping panels 32 of cavities 30 and 31, as shown by arrow 41. As is well-known, whenever any area of low-pressure exists, air from a higher pressure source will flow to the low-pressure area in an attempt to stabilize the low-pressure area. Since a continuous flow of heated air from hair dryer 25 maintains the low-pressure area adjacent pocket/zone 40, ambient air continuously flows into slots 34 in a constant attempt to eliminate or stabilize the area of low-pressure. As a result, the volume of air flowing out of hair dryer 25 and through hair dryer attachment 20 is substantially increased by the air drawn through slots 34.

As shown in FIG. 5, in the preferred construction of the present invention, inner tube member 22 incorporates a radially extending flange 44 formed co-extensively with leading edge 38. Flange 44 is constructed for nested engagement with a slot formed in the interior surface of housing 21. In this way, tube member 22 is securely positioned in housing 21, in the precisely desired position and orientation.

As depicted in FIGS. 1–5, outlet portal 24 comprises an enlarged, generally oval shape, which is formed by arcuately curved, diverging sidewalls 45 and 46. In the preferred construction, sidewalls 45 and 46 are integrally formed on the diametrically opposite sides of housing 21, commencing in an area generally adjacent trailing edge 39 of tube member 22. Sidewalls 45 and 46 extend from this initial position in a diverging, outwardly extending configuration, forming enlarged, fan-shaped, oval outlet portal 24. By continuously expanding outwardly to form outlet portal 24, this construction encompasses a substantially increased volume than would otherwise be achieved by a conventional circular shaped tube. As a result, the substantially increased air volume achieved by drawing ambient air into the flow path is capable of being easily accommodated and effectively delivered to the user.

By providing enlarged outlet portal 24 along with arcuately curved, diverging sidewalls 45 and 46, which defines the flow path for the combined heated air and ambient air, a unique, highly effective, air flow delivery system is achieved for producing a substantially increased volume of air and delivering the increased volume of air directly to the hair of the user at a substantially elevated temperature. As a result, substantially increased and enhanced drying of the user's hair is realized.

Figure 8:
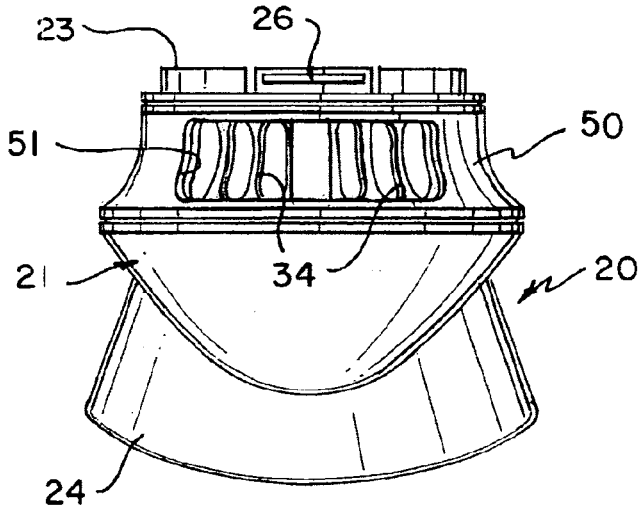
FIG. 8 is a top plan view of an alternate embodiment for the hair dryer attachment of the present invention.
Figure 9:
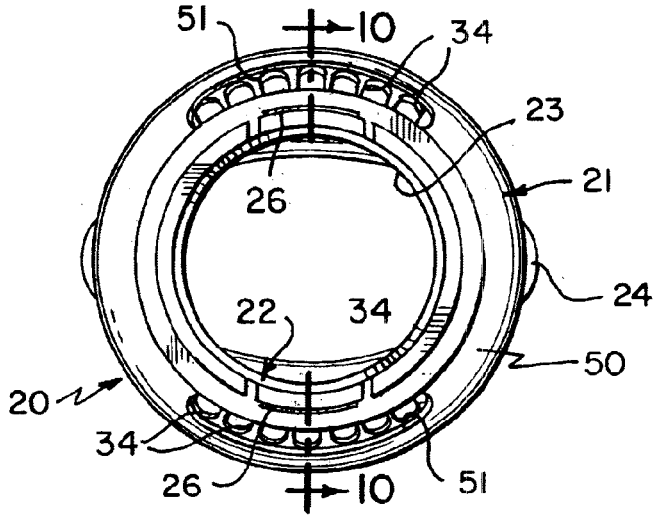
FIG. 9 is a rear elevation view of the hair dryer attachment of FIG. 8, depicting the inlet portal thereof.
Figure 10:
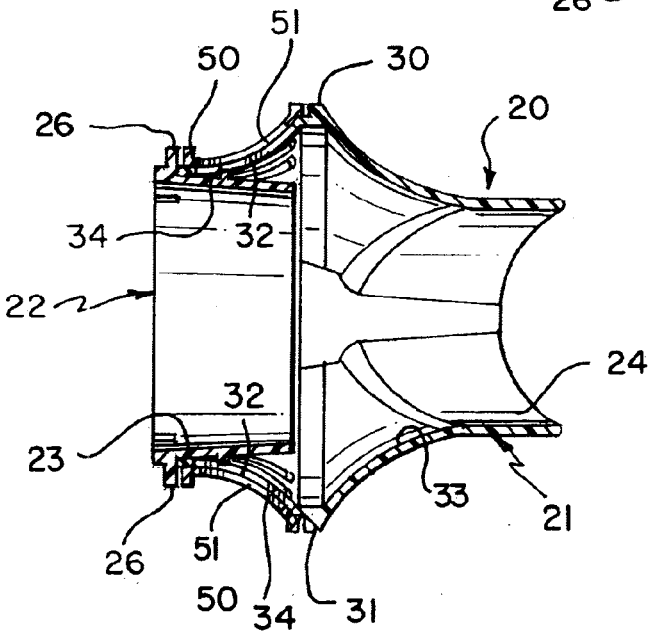
FIG. 10 is cross-sectional side elevation view of the hair dryer attachment taken along line 10—10 of FIG. 9.

By referring to FIGS. 8–10, along with the following detailed discussion, the construction and operation of a second preferred embodiment of the present invention can best be understood. In this embodiment, hair dryer attachment 20 is constructed in a manner consistent with the embodiment detailed above. As a result, similar reference numerals are employed in FIGS. 8–10 when referring to substantially identical components.

As depicted, in this embodiment, hair dryer attachment 20 comprises housing 21 in combination with tube member 22 which is mounted within housing 21. In addition, housing 21 incorporates a generally circular shaped inlet portal 23 and an output portal 24.

In this embodiment, as with the embodiment detailed above, inlet portal 23 is constructed for being quickly and easily securely mounted to the exit portal of a conventional hair dryer. Although any desired mounting/engagement system can be employed, the incorporation of radially extending tabs or ridges 26 formed on the outer surface of portal 23 enables hair dryer attachment 20 to be quickly and easily inserted into the exit portal of a hair dryer and locked in place.

In this embodiment, housing 21 of hair dryer attachment 20 incorporates outwardly extending raised cavities 30 and 31 which are preferably formed diametrically opposed from each other. In addition, outwardly extending raised cavities 30 and 31 each comprises an upwardly sloping surface or panel 32 extending upwardly from the inlet portal side of housing 21, and a downwardly extending panel or surface 33 extending from the terminating edge of panel/surface 32 towards output portal 24. In addition, a plurality of apertures 34 are formed in each panel/surface 32. In the preferred construction, apertures 34 comprise elongated slots extending substantially the entire width of panel/surface 32.

In the preferred construction of this alternate embodiment, attachment 20 also incorporates air flow control member 50 mounted to housing 21. In the preferred embodiment, air flow control member 50 comprises a generally circular shaped ring member which peripherally surrounds the entire outer surface of housing 21 in the area which comprises panels/surfaces 32 of raised cavities 30 and 31. In addition, air flow control member 50 incorporates at least one, elongated opening or portal 51 which comprises a substantial arcuate length thereof.

In its preferred construction, air flow control member 50 incorporates two portals 51, each of which are constructed with an arcuate length and position for cooperating with portals 34 formed in panels/surfaces 32 of raised cavities 30 and 31. As depicted, portals 51 of air flow control member 50 are positioned in juxtaposed, spaced, vertically aligned, overlying, cooperating relationship with portals 34. By arcuately rotating air flow control member 50 relative to housing 21 about the central axis defined by air flow control member 50, portals 51 of air flow control member 50 are moved into blocking relationship with portals 34 of panels/surfaces 32. Furthermore, depending upon the arcuate movement of air flow control member 50 about housing 21, portals 34 may be blocked in their entirety or, alternatively, any desired quantity of portals 34 can be exposed or opened.

By employing air flow control member 50, a user is able to alter the amount of ambient air which is capable of flowing through portals 34. If no additional air flow is desired, portals 34 be closed in their entirety, by arcuately rotating air flow control member 50 into a position where portals 51 overlies an area of raised cavities 30 and 31 which is devoid of any portals 34.

Alternatively, if maximum air flow is desired, portals 51 of air flow control member 50 are arcuately rotated to a position where portals 51 are aligned with portals 34 in a manner which exposes portals 34 formed in raised cavities 30 and 31. Furthermore, as is evident from this detailed discussion, air flow control member 50 may be rotated into any desired alternate position, thereby blocking and/or exposing any desired quantity of portals 34. In this way, the quantity of air which is capable of flowing through portals 34 into hair dryer attachment 20 of the present invention is capable of being quickly and easily controlled by the user.

The remaining elements and construction details incorporated into this embodiment of hair dryer attachment 20 is substantially identical to the elements and construction details provided above in reference to FIGS. 1–7. Consequently, all additional disclosure provided above is incorporated herein by reference.

It will thus be seen that the objects set forth above, among those made apparent from the preceding description, are efficiently attained and, since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described our invention, what we claim as new and desire to secure by Letters Patent is:

1. An attachment for a hair dryer constructed for enhancing the efficacy of the hair dryer, said attachment comprising:

A. an elongated, generally cylindrically shaped housing defining an airflow passageway for the heated air exiting the hair dryer, and having a proximal end constructed for being securely affixed to the outlet end of the hair dryer and a distal end constructed for providing a widely dispersed flow of the heated air passing therethrough, and B. a plurality of apertures formed into housing and constructed for enabling ambient air to pass through the apertures into the airflow passageway, whereby ambient air is drawn into the heated airflow for substantially increasing the volume of air passing through the distal end of the housing, thereby increasing the speed with which the hair is dried, wherein said housing is further defined as incorporating at least one outwardly extending, raised cavity integrally formed therein and incorporating at least one portal formed in the raised cavity.

2. The attachment defined in claim 1, wherein said housing comprises two separate and independent raised cavities formed therein and positioned diametrically opposed from each other.

3. The attachment defined in claim 1, wherein said outwardly extending, raised cavity is further defined as being formed by two, cooperating, sloping surfaces, a first surface which extends upwardly from the proximal side of the housing and a second surface which extends from the terminating edge of the first surface downwardly towards the distal end of the housing.

4. The attachment defined in claim 3, wherein said first surface is further defined as comprising a plurality of portals formed therein.

5. The attachment defined in claim 4, wherein each of said plurality of portals is further defined as comprising elongated slots formed in the first surface with each slot longitudinally extending along a substantial area of the first surface, and being aligned with each other in juxtaposed, spaced, relationship.

6. The attachment defined in claim 1, wherein said attachment further comprises a cylindrically shaped tube member mounted in the housing coaxially aligned with at least the proximal end of the housing, with said tube member extending from the proximal end of the housing to its distal end terminating within the housing.

7. The attachment defined in claim 6, wherein the distal end of the tube member is further defined as terminating in spaced alignment with the portals of the raised cavity.

8. The attachment defined in claim 7, wherein said tube member is further defined as having a generally truncated conical shape, with the diameter of the proximal end being greater than the diameter of the distal end.

9. The attachment defined in claim 8, wherein the distal end of the tube member is further defined as being cooperatively associated with the outwardly extending, raised cavity formed in the housing, effectively establishing a pocket or zone therebetween.

10. The attachment defined in claim 9, wherein the pocket or zone is further defined as comprising a reduced pressure level whenever air is flowing through the truncated, conically shaped tube member, thereby causing ambient air to be drawn into said pocket or zone through the portals formed in the cavity of the housing.

11. The attachment defined in claim 9, wherein the pocket or zone is further defined as comprising a reduced pressure level whenever air is flowing through the truncated, conically shaped tube member, thereby causing ambient air to be drawn into said pocket or zone through the portals formed in the cavity of the housing.

12. The attachment defined in claim 11, wherein the distal end thereof is further defined as comprising an enlarged, generally oval shaped configuration formed by arcuately curved, diverging sidewalls, enabling increased airflow to be widely dispersed onto the hair of the user.

13. The attachment defined in claim 1, wherein the distal end thereof is further defined as comprising an enlarged, generally oval shaped configuration formed by arcuately curved, diverging sidewalls, enabling increased airflow to be widely dispersed onto the hair of the user.

14. The attachment defined in claim 1, and further comprising:

C. a movable flow control member mounted to the housing in cooperating relationship with the portals formed therein, said flow control member incorporating at least one enlarged portal position in overlying, cooperating relationship with the portal of the housing, whereby movement of the flow control member relative to the housing causes the effective open passageway from the ambient to the interior of the housing to be controllably altered, whereby the air capable of flowing through the passageway is quickly and easily controlled.

15. An attachment for a hair dryer constructed for enhancing the efficacy of the hair dryer, said attachment comprising:

A. an elongated, generally cylindrically shaped housing defining an airflow passageway for the heated air exiting the hair dryer, and having a proximal end constructed for being securely affixed to the outlet end of the hair dryer and a distal end constructed for providing a widely dispersed flow of the heated air passing therethrough, B. at least one outwardly extending, raised cavity integrally formed therein and incorporating a plurality of apertures formed therein and constructed for enabling ambient air to pass through the apertures into the airflow passageway, and C. a cylindrically shaped tube member mounted in the housing coaxially aligned with at least the proximal end of the housing, with said tube member extending from the proximal end of the housing to its distal end terminating within the housing in cooperating relationship with the raised cavity and forming a pocket or zone therebetween;

whereby ambient air is drawn into the heated airflow for substantially increasing the volume of air passing through the distal end of the housing, thereby increasing the speed with which the hair is dried.

16. The attachment defined in claim 15, wherein said tube member is further defined as having a generally truncated conical shape, with the diameter of the proximal end being greater than the diameter of the distal end.

17. The attachment defined in claim 15, and further comprising:

D. a movable flow control member mounted to the housing in cooperating relationship with the portals formed therein, said flow control member incorporating at least one enlarged portal position in overlying, cooperating relationship with the portal of the housing, whereby movement of the flow control member relative to the housing causes the effective open passageway from the ambient to the interior of the housing to be controllably altered, whereby the air capable of flowing through the passageway is quickly and easily controlled.

* * * * *